US006517361B1

(12) United States Patent
Yatskov et al.

(10) Patent No.: US 6,517,361 B1
(45) Date of Patent: Feb. 11, 2003

(54) PRESET BEND PROVIDING STRAIN RELIEF IN AN ELECTRIC CONNECTOR

(75) Inventors: Alexander I. Yatskov, Kenmore, WA (US); Stephen V. R. Hellriegel, Bainbridge Island, WA (US)

(73) Assignee: Cray Inc., Seattle, WA (US)

( * ) Notice: Subject to any disclaimer, the term of this patent is extended or adjusted under 35 U.S.C. 154(b) by 0 days.

(21) Appl. No.: 09/706,347

(22) Filed: Nov. 3, 2000

(51) Int. Cl.[7] ..... H01R 12/00

(52) U.S. Cl. ..... 439/67; 174/117 F; 439/459; 439/456; 439/492; 439/499

(58) Field of Search ..... 174/117 F, 117 FF; 439/67, 459, 456, 492, 499

(56) References Cited

U.S. PATENT DOCUMENTS 6,194,664 B1 * 2/2001 Zamora et al. ..... 174/177 F

* cited by examiner

*Primary Examiner*—Tho D. Ta
(74) *Attorney, Agent, or Firm*—Harold H. Bennett, II; Seed IP Law Group PLLC

(57) ABSTRACT

A preset bend resulting in a strain relief in a flexible conductor strip that interconnects relatively displaceable first and second electrical contacts that are originally relatively oriented in first spaced apart positions and moveable to second more distantly spaced apart positions. The preset bend includes a substantially straight first leg extending substantially perpendicularly to an axis of relative motion between the first and second interconnected electrical contacts and feeding into a substantially hemi-circular- curve, which continues into a second leg extending toward the second electrical contacts in their spaced apart position.

12 Claims, 6 Drawing Sheets

PRESET BEND PROVIDING STRAIN RELIEF IN AN ELECTRIC CONNECTOR

TECHNICAL FIELD

This invention relates to strain relief of electrical conductors, and in particular to strain relief devices and strain relief bends in flexible electrical conductor strips.

BACKGROUND OF THE INVENTION

Flexible conductor strips, commonly referred to as "flex strips," are often used to electrically interconnect circuit boards in an assembly, connectors on a circuit board, and other electrical devices that move relative to one another either during test and assembly or during their functional life. Flex strips are generally well known in the art as multiple flat electrical conductors usually laid out in parallel strips and encased in a flexible nonconductive material, such as kapton, and having connection means, usually either pins or holes for insertion of male pins, at either end of each conductive strip. In use, the flex strips are mounted on the electrical assemblies or devices to be interconnected with solder joints at the ends of the conductive strips insuring electrical connectivity. The resulting flexible electrical interface, i.e., the flex strip, can be bent and twisted within limits and remains operational. However, if the flex strip is torn, creased or pressed into the wrong position, the thin conductive traces therein may be broken, destroying the signal path, thus causing loss of data. Further, if the flex strip is repeatedly stressed beyond certain limits, the fatigue life of the conductors may be exceeded causing the resistance in the conductor to increase, or even failure over a period of use. Replacing the flexible conductors is very difficult and time consuming once they are in place within a computer assembly, therefore it is important that the flex strip remain fully operational for use over many years, beyond the expected life of the machines in which they are placed.

SUMMARY OF THE INVENTION

The present invention provides a preset bend of a known curvature and orientation in a flexible conductor strip interconnecting first and second electrical contacts. The distance between the first and second electrical contacts varies as they are connected to and removed from each other. According to one aspect of the invention, the preset bend includes a substantially straight first leg extending substantially perpendicularly to an axis of relative motion between the first and second interconnected electrical contacts feeding into a substantially hemi-circular curve, which continues into a second leg extending toward the second electrical contacts in their spaced apart position.

The preset bend is formed in a flexible electrical conductor strip, such that the flexible conductor strip is formed with a substantially straight first leg extending substantially perpendicularly to an axis of relative motion between the first and second interconnected electrical contacts feeding into a substantially hemi-circular curve, which continues into a second leg extending toward the second electrical contacts in their spaced apart position.

According to yet another aspect of the invention, the invention provides a strain relief assembly having a first conductor guide defining a concave surface facing toward the contact mounting surface and away from the first spaced apart position occupied by the second electrical contacts in their spaced apart position, and a second conductor guide defining a convex surface facing toward, substantially coextensive with, and spaced a predetermined distance away from the assembly's concave surface.

According to still another aspect of the invention, the invention provides an electrical connector that is translatable relative to a mounting surface between the first and second spaced apart positions, which are each spaced away from electrical contacts that are stationary relative to the mounting surface. The translatable electrical connector is substantially enclosed within the connector housing, which is fixed in a position relative to the mounting surface and the stationary electrical contacts. The connector housing also preferably includes at least one of a third conductor guide mounted on one side the mounting surface and extending therefrom toward the conductor guides. A fourth conductor guide mounted on the other side adjacent to the mounting surface and extending therefrom may also be used.

According to other aspects of the invention, the present invention provides various methods for forming a preset stress relief bend in a flexible electrical conductor strip.

DETAILED DESCRIPTION OF THE INVENTION

Figure 1:
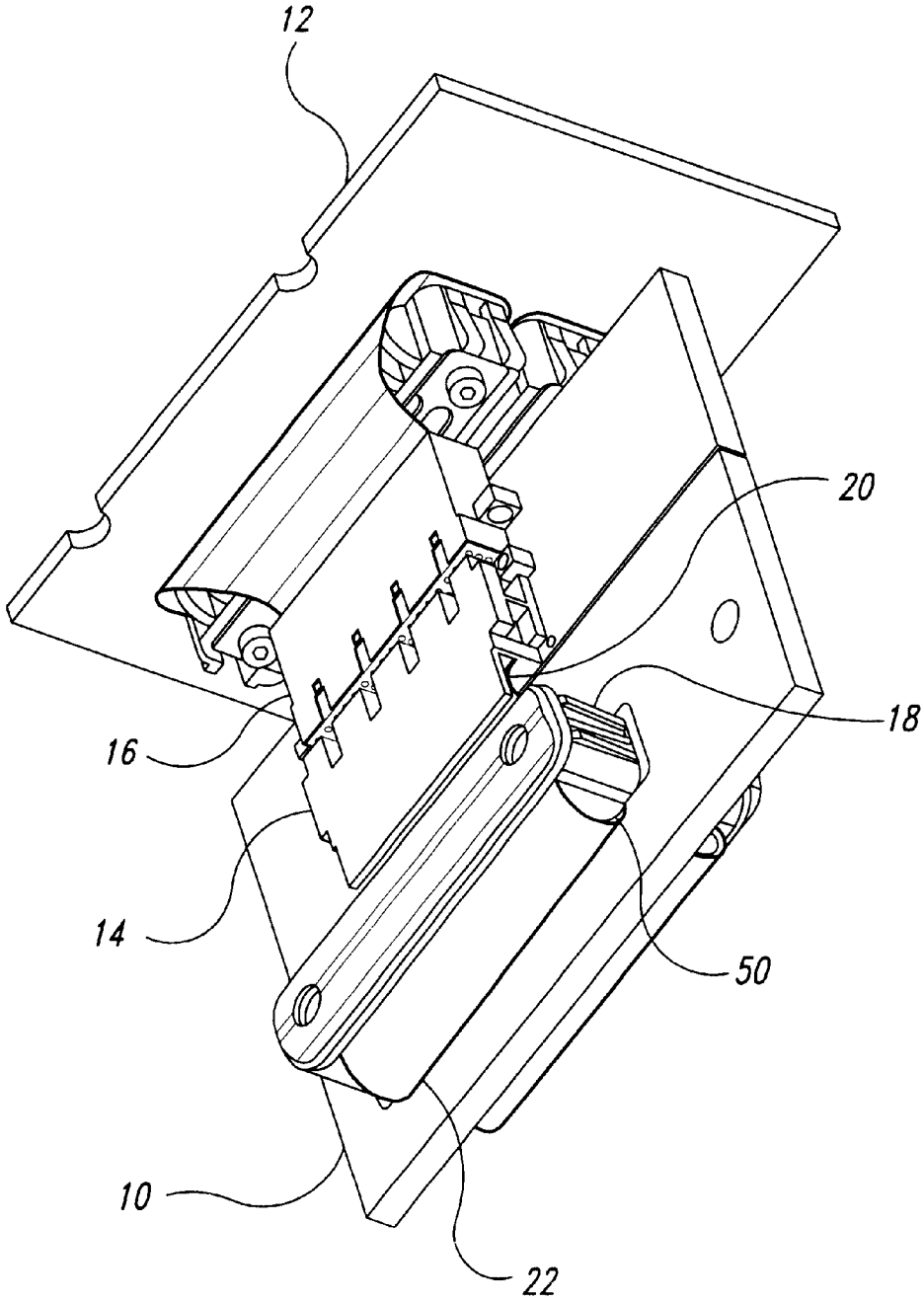
FIG. 1 illustrates the interconnection of a circuit board into another circuit board by insertion of a movable connector on a circuit board into a mating stationary connector mounted on the other circuit board.

FIG. 1 illustrates the interconnection of a circuit board 10 into another circuit board 12 by insertion of a connector 14 on circuit board 10 into a stationary mating connector 16 mounted on circuit board 12. The circuit board 12 may be any other electrical component to which connection is required. For example, in one embodiment, the circuit board 12 is the top plane connector in a large computer system. Such a top plane connector may have a large number of electrical conductors thereon for providing electrical signals between parallel boards mounted in the computer. Alternatively, the circuit board 12 may be a back plane, a motherboard or some other circuit board having integrated circuits thereon. Thus, the circuit board 12 includes any other electrical components to which a connection is required.

Connector 14 is moveable relative to circuit board 10 so that after circuit board 10 is physically in place relative to circuit board 12 connector 14 is subsequently inserted into mating connector 16 thereby reducing the opportunities for delicate pins on one of the connectors 14 and 16 being inadvertently damaged by overly aggressive insertion when circuit board 10 is seated. According to the present invention, connector 14 is interconnected electrically to circuit board 10 via stationary connector 18. As shown more clearly in subsequent figures, a first flex strip 20 electrically interconnects connector 14 with stationary connector 18 and allows connector 14 to move relative to stationary connector 18 and thus relative to circuit board 10. Stationary connector 18 is in turn electrically interconnected to circuit board 10 via a second flex strip 22, which is described in greater detailed below.

Alternatively, first and second flex strips 20 and 22 are optionally formed as a single flex strip interconnecting connector 14 with circuit board 10 directly. Accordingly stationary connector 18 is eliminated and replaced by a structure supporting strain relief assembly 24.

Figure 2A:
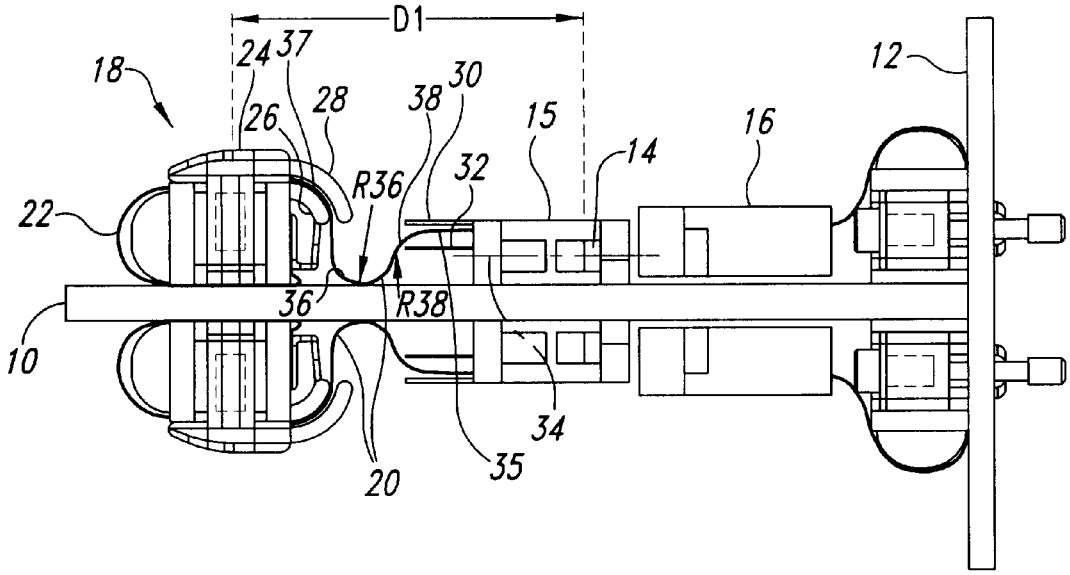
FIG. 2A illustrates a preset bend in a flexible conductor strip that provides a configuration control and curvature orientation according to one embodiment of the present invention.

FIG. 2A illustrates the preset bend of the invention in flex strip 20 which provides a configuration control and curvature orientation. In FIG. 2A, strain relief assembly 24 is located in a predetermined position with a predetermined orientation relative to stationary connector 18 and circuit board 10. Strain relief assembly 24 includes two curved conductor guides 26 and 28.

Figure 2B:
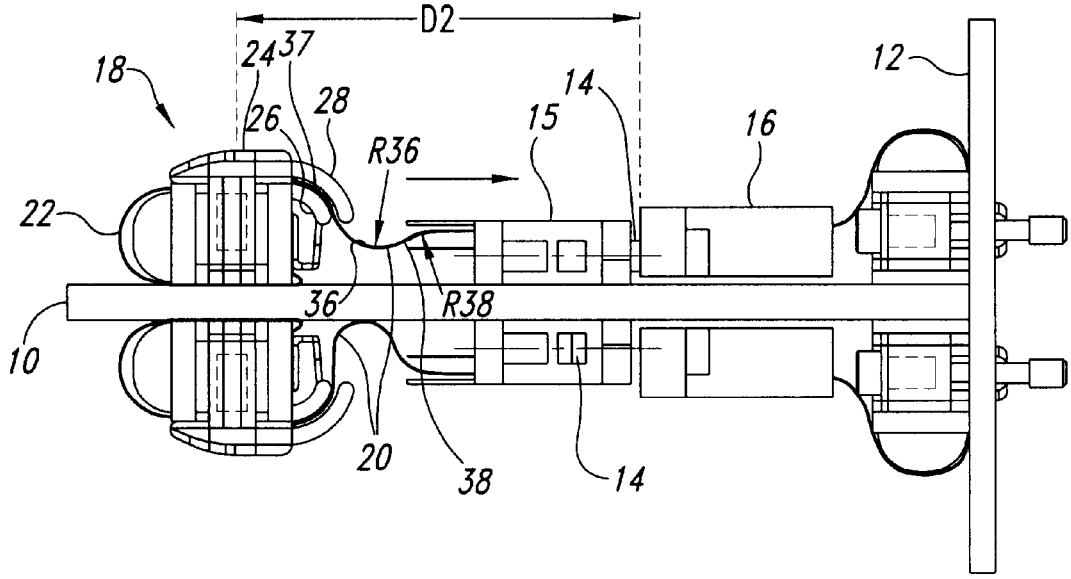
FIG. 2B illustrates a change in shape of preset bends in a flexible conductor strip according to one embodiment of the present invention when an interconnected moveable connector is translated relative to the strain relief device of the invention for insertion into a mating connector.

FIG. 2A shows connector 14 within stationary housing 15. In FIG. 2A, connector 14 is shown in a first position that, while disengaged from mating connector 16, is spaced a predetermined distance D1 away from strain relief assembly 24. FIG. 2B illustrates the change in shape of preset bend 36 when moveable connector 14 is translated along axis 34 relative to circuit board 10 to a second pre-determined distance D2 away from strain relief assembly 24 and inserted into mating connector 16. The distances D1 and D2 are measured from the back most portion of connector 14; as will be appreciated, the front portion has a number of apertures with electrodes therein which mate with pins inside connector 16 when it is in the forward position.

Connector guides 26 and 28 of strain relief assembly 24 direct first flex strip 20 toward circuit board 10. An inherent stiffness in conductor strip 20 causes it to intersect with circuit board 10 in a smoothly curving arch. Interconnection of flexible conductor strip 20 with moveable connector 14 causes flexible connector strip 20 to continue in a smooth arch in a direction toward moveable connector 14.

According to one embodiment of the invention. connector housing 15 includes additional conductor guides 30 and 32 formed to project in a direction oppositely from the insertion end of connector 14 and parallel with its insertion axis 34. In the application illustrated, connector guides 30 and 32 thus project substantially parallel to the surface of circuit board 10 toward strain relief assembly 24. Connector guides 26 and 28 of strain relief assembly 24 thus combine with conductor guides 30 and 32 of connector housing 15 and the predetermined length of flexible conductor strip 20 to form a first leg portion 35 that is straight, and a preset bend portion 36 in flexible conductor strip 20. Preset bend 36 forms a U-shaped curve with one leg of the U extending from between conductor guides 26 and 28 toward the mounting surface of circuit board 10, and the other leg of the U curving in a second preset bend 38 toward moveable connector 14. There is a third bend 37 of a preset curvature inside the channel between the guide members 26 and 28. Since the guide members are rigid, this bend does not change curvature when the connector 14 is moved.

FIG. 2B illustrates that flexible conductor strip 20 is configured in relationship to the first and second positions of moveable connector 14, i.e., respective pre-insertion and inserted positions of translatable connector 14, such that, with connector 14 in its second inserted or mated position, flexible conductor strip 20 is sufficiently long relative to the physical gap between strain relief assembly 24 and connector 14 that flexible conductor strip 20 retains at all times such curvature. In other words, flexible conductor 20 is long enough that bend 36 does not completely straighten when moveable conductor 14 is translated from its first non-inserted position into its second position inserted into mating connectors 16. As will be described in greater detailed below, conductor guides 26 and 28 combine to guide the curvature of flex strip 20 such that U-shaped preset bend 36 becomes more shallow when connector 14 is moved into its inserted position with mating connectors 16, but retains at all times a convex curvature directed toward circuit board 10. In other words, the radius R 36 of preset bend 36, shown in FIG. 2A, flattens out to a second larger radius R 36 with an unchanged direction of curvature when moveable connector 14 is translated along axis 34 from its pre-insertion position to its inserted position relative to mating connector 16.

Furthermore, second preset bend 38 also flattens out to a second larger radius when connector 14 is moved into its second position inserted into mating connector 16, but also at all times retains a convex curvature directed away from circuit board 10. Thus, preset bend radius R 38, shown in FIG. 2A flattens out to a larger radius R 38 when connector 14 is moved into its inserted position.

Figure 3A:
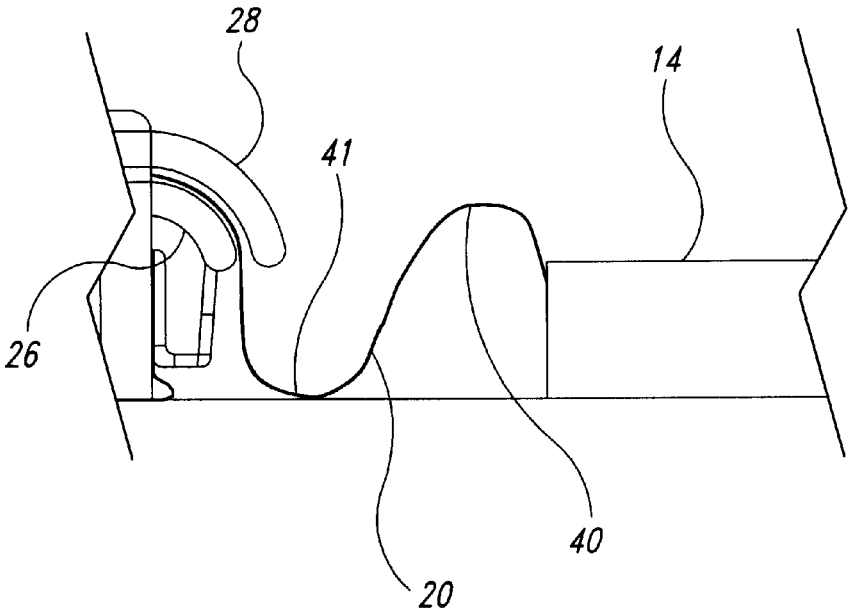
FIG. 3A illustrates a preset bend in a flexible conductor strip that provides a configuration control and curvature orientation according to an alternative embodiment of the present invention.

FIG. 3A illustrates an alternate configuration of moveable connector 14 having its electrical connection at a surface opposite from its insertion end. In FIG. 3A, flexible connector strip 20 again exits from between conductor guides 26 and 28 of strain relief assembly 24 and is curvingly deflected from circuit board 10. The flexible connector strip 20 follows U-shaped curve 41, which is curved back on itself to form an S-shape having a second preset bend 40. Each of preset bends 41 and 40 are determined by the curvature of conductor guides 26 and 28 in combination with the length of flexible conductor strip 20 relative to the spacing between strain relief assembly 24 and moveable connector 14 in its first pre-insertion position.

Figure 3B:
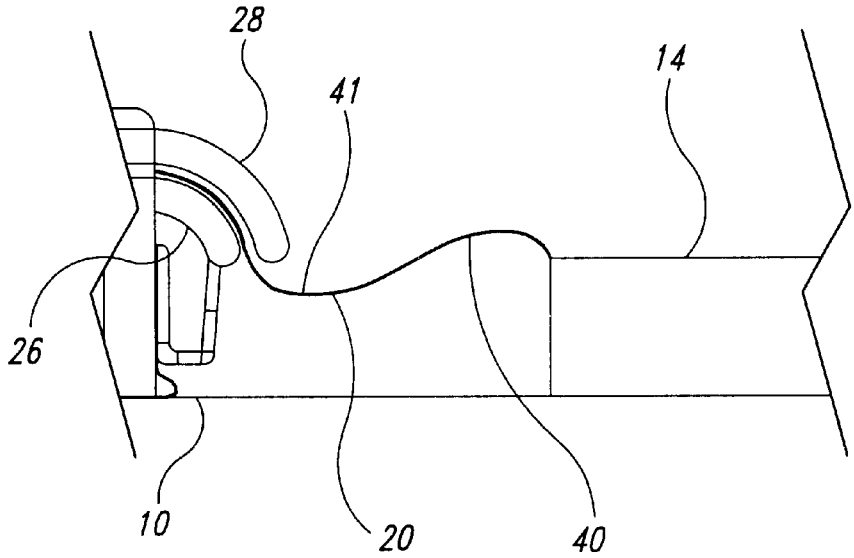
FIG. 3B illustrates a changed curvature in preset bends in a flexible conductor strip according to an alternative embodiment of the present invention when an alternative interconnected moveable connector is moved relative to the strain relief device of the invention for insertion into a mating connector.

FIG. 3B illustrates the changed curvature in preset bends 41 and 40 of flexible conductor strip 20 when alternate connector 14 is moved from its first pre-insertion position to its second position inserted into mating connector 16. As with the preset bends 36 and 38 of FIG. 2, preset bends 41 and 40 of S configured conductor 20 are substantially flattened but do not change sign. Strain relief conductor guides 26 and 28 again cause flexible conductor 20 to retain the same direction of curvature for preset bends 41 and 40 while allowing them to substantially increase their respective radius of curvature. The retention of some amount of preset bend 41 and 40 with their respective direction of curvature intact insures that flexible conductor strip 20 will return to its original configuration, including preset bends 41 and 40 when connector 14 is returned to its original pre-insertion position.

The structure of the present invention. as shown in FIGS. 2A, 2B, 3A and 3B provide a number of advantages. The flexible conductor strip 20 is protected from inadvertently shifting into a configuration such that it is exposed to contact or impact from objects which may be adjacent the connector assembly. For example, if the curvature at the rest position were concave with respect to the board, extending outward then the conductive strip would be exposed and susceptible to impact since it would be sticking up in the air, unprotected. However, as can be seen by viewing FIG. 1, together with FIGS. 2A and 2B, the conductor 20 is held in a protected location, nested between two relatively large conductors. These serve as protection, or blocking members to prevent any damage by impact to the conductor strip 20. A further advantage is that the exact shape and radius of curvature of the conductive strip 20 is known at all times during various positions. The amount of curvature is selected to ensure that at no time does it exceed that amount which would cause stress, strain or excessive fatigue in a conductor strip 20 as the connector 14 moves back and forth. The user can therefore be assured that the conductor strip 20 will not receive creases, bends or other movement which may cause damage to the electrically conductive traces therein.

Figure 4:
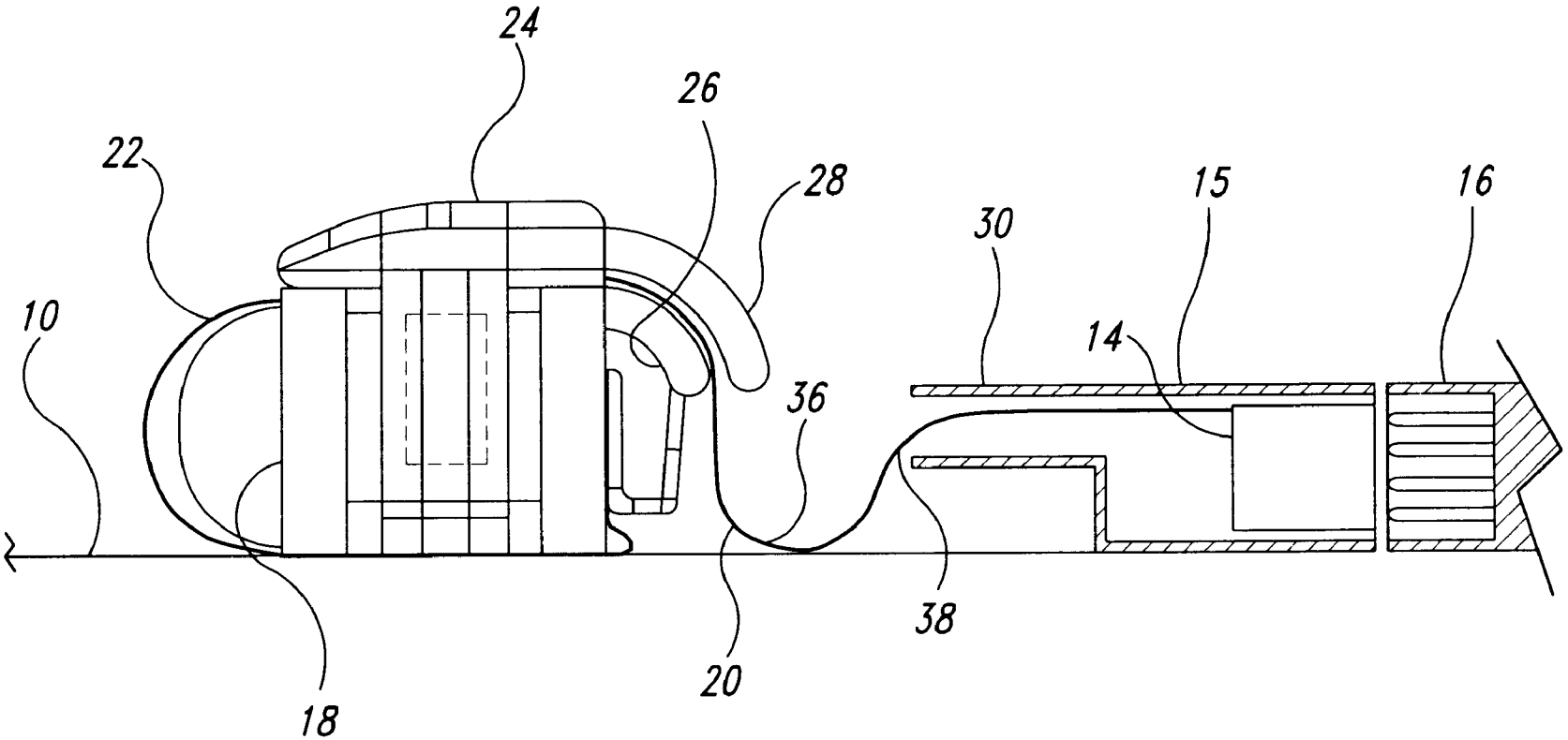
FIG. 4 is a enlarged view of strain relief assembly according to one embodiment of the present invention and relatively movable connector with a flexible conductor strip extending between them.

FIG. 4 is a enlarged view of strain relief assembly 18 and connector 14 with flexible strip 20 extending between them. Conductor guides 26 and 28 are configured with respective convex and concave surfaces spaced apart about the thickness of flexible conductor strip 20. The arching track defined by spaced apart surfaces of conductor guides 26 and 28 is defined to capture flexible conductor strip 20 and direct it substantially perpendicularly toward circuit board 10. The inherent stiffness of flexible conductor strip 20 causes it to follow the path provided by conductor guides 26 and 28 toward the circuit board 10 in a substantially straight line. The inherent stiffness also causes flexible strip 20 to bend in a smooth arch at its intersection with circuit board 10. Interconnection with connector 14 perpendicular to its exit track from conductor guides 26 and 28, as shown in FIG. 2A, inverts the curve and causes flex strip 20 to arch smoothly toward connector 14. According to the embodiment described in FIG. 4, additional conductor guides 30 and 32 on connector housing 15 urge flexible conductor strip 20 into second preset bend 38. Thus, when connector 14 at is its first pre-insertion position, flexible conductor strip 20 extends from the space between the first and second conductor guides 26 and 28 and forms a compound U-shaped curve with its convex surface facing away from conductor guides 26 and 28 towards circuit board 10. A leg of the U-shaped curve bends in a smooth arch into the track defined by second conductor guides 30 and 32 on connector housing 15, which is perpendicular to the first leg of the U extending from the track between conductor guides 26 and 28. Preferably, each of conductor guides 26 and 28 are formed with rounded lips at the end of the track they define. The rounded lips protect flexible conductor strip 20 from sharp edges that could cut through the lamination or damage the conductors.

Figure 5A:
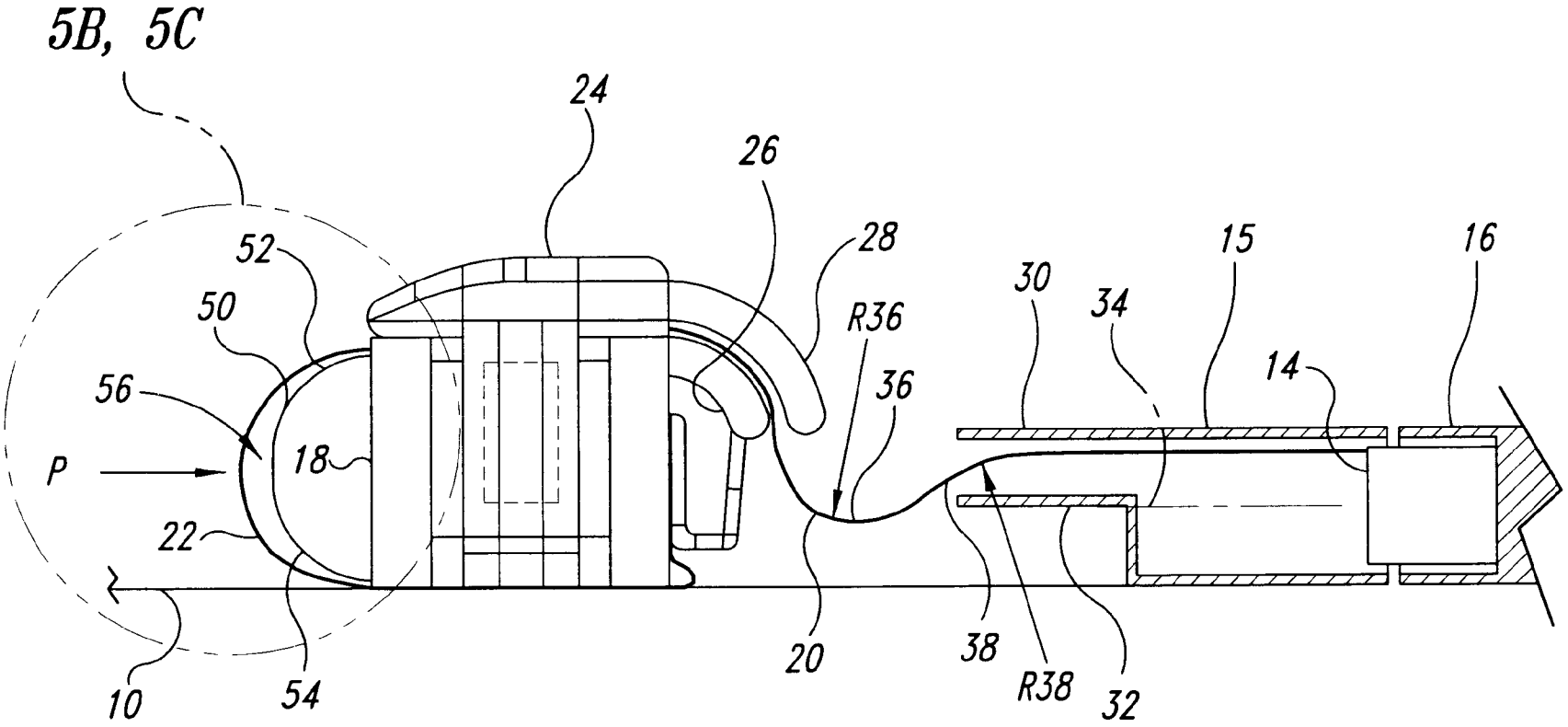
FIG. 5A illustrates a flexible conductor strip in a extended configuration when the movable connector is moved to a second position inserted into a mating connector, wherein the curvature of the flexible strip is substantially straightened, but the preset bends of the present invention are maintained.

FIG. 5A illustrates flexible conductor strip 20 in a extended configuration when connector 14 is in a second position inserted into mating connector 16. The curvature of flexible strip 20 is substantially straightened, but preset bends 36 and 38 are maintained with their respective original senses. The curvature R 36 of first preset bend 36 is substantially flatter when connector 14 is inserted into mating connector 16, such that radius R 36 when extended is larger than radius R 36 when retracted as shown in FIGS. 4 and 5A. The radius R 38 is also larger when the connector 14 is extended than corresponding radius R 38 when connector 14 is retracted. Although preset bends 36 and 38 are substantially flatter, each retains its original sign so that the convex and concave nature of each remains unchanged relative to conductor guides 26 and 28 of strain relief assembly 24 and to connector 14.

FIG. 5A also illustrates second strain relief 50 which provides strain relief for second flexible conductor strip 22. Strain relief 50 is a combination of at least two curving surfaces 52 and 54 together defining a semicircular surface. Second flexible conductor 22 is formed in a semicircular arch between opposing surfaces of connector 18. For example, conductor 22 is formed having one end interconnected to circuit board 10 beneath connector 18 and the other end connecting with first flexible conductor strip 20 at a surface of connector 18 opposite from circuit board 10. Each of second conductor strip 22 and second strain relief 50 are configured with a surface length such that in a condition where a second flexible strip 22 is constrained relative to strain relief 50 a gap 56 is formed therebetween. Furthermore, the relative semicircular lengths of second flexible conductor strip 22 and strain relief 50 are configured such that gap 56 therebetween permits only a small relative motion of flexible conductor strip 22 before contact with the semicircular surface of strain relief 50 is established. Relative motion of flexible conductor strip 22 is thereby restricted to an extent that the orientation of its interface to conductor 18 remains relatively unchanged when a force or pressure P presses against strain relief 50 thereby closing the gap 56 therebetween.

Figure 5B:
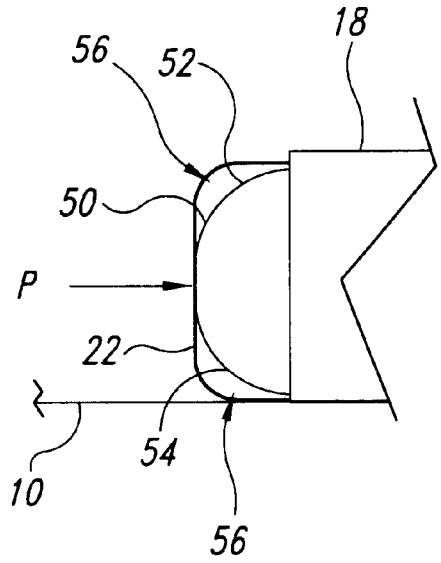
FIG. 5B illustrates a second strain relief of the invention which provides strain relief for a second flexible conductor strip by providing a combination of at least two curving surfaces that together defining a substantially semicircular surface.

FIG. 5B illustrates a configuration of flexible conductor strip 22 in a condition wherein a force or pressure P applied parallel to circuit board 10 presses conductor 22 against strain relief 50. Such a configuration is defined by a straightening or "squaring" of the curvature exhibited by flexible conductor 22 in its relaxed state. As illustrated, the surface of strain relief 50 restricts extreme displacements of flexible conductor strip 22 and protects against kinking of and possible damage to the conductors therein.

Figure 5C:
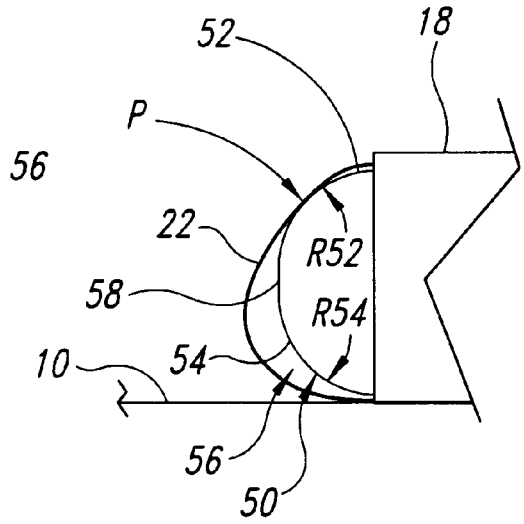
FIG. 5C illustrates a configuration of the second strain relief of the invention wherein the strain relief device includes an additional surface extending between the two curved strain relief surfaces defining a substantially semicircular surface, which extends the potential effective length of the strain relieved conductor strip.

FIG. 5C is yet another illustration of the strain relief 50 wherein a force or pressure $P^1$ is applied to flexible conductor strip 22 from a position above strain relief 50 and circuit board 10. In such instance, flexible conductor 22 is again distorted relative to its relaxed configuration, but strain relief 50 restricts the extent of motion available to flexible conductor 22 such that it retains its orientation relative to connector 18 at the extremes of strain relief 50. Thus, flexible conductor strip 22 is protected from kinking or damage.

FIG. 5C also illustrates a configuration of strain relief 50 wherein a non-curved strain relief surface 58 extends between curved strain relief surfaces 52 and 54 thereby extending the potential effective length of second conductor strip 22. Preferably, the radii are R52 and R54 of respective curved strain relief surfaces 52 and 54 chosen in combination with the length of flat strain relief surface 58 and the length of flexible conductor strip 22 such that externally applied pressure P and $P^1$ distort the relaxed shape of flexible conductor strip 22 yet protect it from kinking and from damage to the conductors thereof.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. An electrical conductor strip, the conductor strip comprising:

first and second electrical contacts at first and second ends, respectively, of the conductor strip, interconnected thereby, and relatively oriented in a spaced apart position;

a substantially straight first leg extending from the first contact and substantially parallel to an axis of relative motion between the first and second interconnected electrical contacts;

a curved portion extending from an end of said first leg; and a second leg extending from an end of said curved portion toward said second electrical contact, the curved portion and the second leg defining a preset bend providing strain relief in the conductor strip.

2. The conductor strip recited in claim 1 wherein the curved portion includes:

a substantially hemi-circular curve extending from the end of said first leg.

3. The conductor strip recited in claim 1, wherein the first electrical contact is slideably coupled to a mounting surface, and wherein said substantially straight first leg further comprises a substantially straight first leg extending from the first contact and substantially parallel to the mounting surface.

4. The conductor strip recited in claim 3, wherein the second electrical contact is mounted to the mounting surface at the spaced apart position from the first electrical contact, and wherein the first contact slides from a first distance to a second distance from the second contact.

5. The conductor strip of claim 2, further comprising a first strain relief assembly including:

a first conductor guide having a concave surface, extending toward said mounting surface and away from the second electrical contact; and a second conductor guide having a convex surface facing toward, substantially coextensive with, and spaced a predetermined distance away from said concave surface, and extending away from the second contact.

6. The conductor strip of claim 5 wherein the second leg of the conductor strip, extending from the end of the curved portion, passes between the first and second conductor guides toward the second electrical connector.

7. The conductor strip of claim 5 wherein:

said curved portion extending from the end of said first leg further comprises a convex curve extending toward said mounting surface, and said second leg of said conductor strip further comprises a concave curve extending away from said mounting surface.

8. The conductor strip of claim 7, wherein said concave curve extending away from said mounting surface formed by said second leg of said conductor strip further comprises a second substantially circular curved portion extending from the end of said first leg.

9. An electrical conductor strip, comprising:

first and second electrical contacts coupled to a mounting surface in a spaced apart position;

a first strain relief assembly, including a first conductor guide having a concave surface facing toward the mounting surface and away from the first contact, and a second conductor guide having a convex surface facing toward, substantially coextensive with, and spaced a predetermined distance away from the concave surface, and extending away from the first contact;

a flexible conductor strip interconnecting the first and second contacts and passing between the first and second conductor guides;

a preset bend defined by the first and second conductor guides and by the spaced apart position of the connectors, providing strain relief in the flexible conductor strip.

10. The electrical conductor strip of claim 9 further comprising:

a substantially straight first leg extending from the first contact and substantially parallel to an axis of relative motion between the first and second electrical contacts;

a curved portion extending from an end of the first leg; and a second leg extending from an second end of said curved portion toward the second electrical contact.

11. The conductor strip of claim 10 wherein:

said curved portion extending from the end of said first leg further comprises a convex curve extending toward said mounting surface, and said second leg of said conductor strip further comprises a concave curve extending away from said mounting surface.

12. The conductor strip of claim 11 wherein said concave curve extending away from said mounting surface formed by said second leg of said conductor strip further comprises a second substantially circular curved portion extending from the end of said first leg.

* * * * *

UNITED STATES PATENT AND TRADEMARK OFFICE

CERTIFICATE OF CORRECTION

PATENT NO. : 6,517,361 B1 
DATED : February 11, 2003
INVENTOR(S) : Alexander I. Yatskov et al.

It is certified that error appears in the above-identified patent and that said Letters Patent is hereby corrected as shown below:

Title page,
Item [54], the title should read as -- PRESET BEND PROVIDING STRAIN RELIEF IN AN ELECTRICAL CONNECTOR --.
Item [57], ABSTRACT,
Line 9, "hemi-circular- curve" should be corrected to read as -- semicircular curve --.

Column 7,
Line 30 "hemi-circular curve" should be corrected to read as -- semicircular curve --.

Signed and Sealed this

Twenty-fourth Day of June, 2003

JAMES E. ROGAN
*Director of the United States Patent and Trademark Office*